United States Patent [19]

Vernon et al.

[11] 4,356,570

[45] Nov. 2, 1982

[54] DIFFERENTIAL THERMAL GARMENT

[76] Inventors: Ruth P. Vernon; James L. Cox, both of 615 Silverton St., Orlando, Fla. 32808

[21] Appl. No.: 161,268

[22] Filed: Jun. 20, 1980

[51] Int. Cl.[3] ..... A41D 13/08

[52] U.S. Cl. ..... 2/16; 2/59; 2/126

[58] Field of Search ..... 2/126, 2 R, 59, 94, 2/16, 69, 1, DIG. 6, 87, 22

[56] References Cited

U.S. PATENT DOCUMENTS

| | | | |
|---|---|---|---|
| 1,424,215 | 8/1922 | Rowe | 2/59 X |
| 1,796,782 | 3/1931 | Gasperini | 2/59 X |
| 3,380,075 | 4/1968 | Marthinsson | 2/126 |
| 4,006,495 | 2/1977 | Jones | 2/126 X |

FOREIGN PATENT DOCUMENTS

| | | | |
|---|---|---|---|
| 11427 | 5/1909 | United Kingdom | 2/126 |

*Primary Examiner*—H. Hampton Hunter

*Attorney, Agent, or Firm*—Reginald F. Pippin, Jr.

[57] ABSTRACT

A garment having differential thermal properties for retaining heat adjacent to the arm and shoulder muscles of an athlete, while allowing the remaining body muscles to naturally cool. The garment comprises a sleeve for covering the arm and a skirt attached to the sleeve for covering the deltoid, pectoral and tarus major and minor muscles adjacent the throwing arm. A coupler is provided for removably attaching the skirt and sleeve to the uniform of the athlete. In a first preferred embodiment this coupler may be a plurality of Velcro patches.

4 Claims, 5 Drawing Figures

DIFFERENTIAL THERMAL GARMENT

BACKGROUND OF THE INVENTION

I Field of the Invention

The present invention relates to athletic garments of the type for differentially cooling various muscles of the athlete, and more particularly to a sleeve and skirt section attached thereto for maintaining body heat in the arm and the adjacent shoulder muscles of a baseball pitcher.

II Description of the Prior Art

The popularity of baseball as a major American sport, both at the amateur and professional levels, has placed substantial importance upon the peak performance of an athlete engaged in this sport. Pitchers are especially prone to injuries of the type commonly referred to as "sore arms" which are typically caused by over-exertion together with improper heating and cooling cycles of the arm muscles. Given the high skill and experience levels required to make a good pitcher, it is extremely important that every effort be made in order to eliminate as many factors as possible which contribute to "sore arms".

It is well known to both participants and fans of the sport of baseball that pitchers frequently put on jackets while in the dugout in order to maintain body heat within the pitching muscles. This retention of body heat in the arm and shoulder muscles will tend to keep the pitching muscles loose between innings and therefore will tend to reduce muscle cramps and muscle tightening. This practice is common for pitchers even during warm weather since it is more important to maintain body heat within the pitching muscles than to promote general body cooling. However, it is more desirable to differentially cool the body by maintaining body heat in the arm and shoulder muscles of the throwing arm while also allowing normal dissipation of body heat from other body areas. This is often accomplished by merely inserting the pitching arm into the shoulder of the jacket, while allowing the remainder of the jacket to hang from the shoulder of the player. While this may be satisfactory when the pitcher is merely sitting on the bench, it is not satisfactory when the pitcher is warming up for his turn at bat, when batting or when running the bases. Furthermore, the insertion of the arm into only the arm of the jacket will not retain body heat in the chest and back muscles which are involved in the throwing motions.

While this problem has been apparent for many generations of baseball players, the present inventor is unaware of any suitable solutions to the aforementioned problem. Some inventors have approached the problem of differential cooling of the torso and arm sections of the body, but the resulting inventions uniformly attempt to maintain body heat in the torso area while dissipating heat from the arms and other body appendages.

For example, Jones in U.S. Pat. No. 4,006,495, discloses a coat which employs semi-detachable sleeves and pocket means for receiving the sleeves in their semi-detached condition. This garment is primarily designed as a hunting jacket for maintaining body heat in the torso area of the athlete, while providing for maximum flexibility of the arms by removing the sleeves therefrom. The sleeves are removably coupled to the main torso section of the jacket through the use of several strips of VELCRO (trademark) fasteners. These Velcro-type fasteners comprise a plurality of small hooks which removably couple with a plurality of loops woven into a separate section of the coupling pieces.

Shuster, in U.S. Pat. No. 2,122,873, discloses a jacket-type garment which employs a linear zipper for removably coupling the sleeves to the torso or main section of the jacket. As with the Jones device described above, both of these jacket garments are designed to maintain body heat within the torso of the athlete and to dissipate body heat from the arms and other appendages. This teaching is entirely contrary to the concept of the present garment which is designed to maintain body heat within the arm and shoulder muscles involved in pitching a baseball and to dissipate body heat from the main torso section.

Other torso garments which employ removable sleeves have been disclosed by Fierst in U.S. Pat. No. 3,378,853, Marthinsson in U.S. Pat. No. 3,380,075, Rosenberg in U.S. Pat. No. 3,154,790, Agostini in U.S. Pat. No. 3,024,466, Cornet in U.S. Pat. No. 2,690,565, Wolfson in U.S. Pat. No. 2,308,411, Bonoff in U.S. Pat. No. 1,155,544, and Nichols in U.S. Pat. No. 1,149,674. None of these references teach the use of a sleeve and skirt of the type which may be used by baseball players or other athletes for maintaining body heat in the arm and shoulder area while allowing for normal dissipation of body heat from the torso and other appendages.

SUMMARY OF THE INVENTION

An athletic garment for providing thermal differential cooling of the active muscles of the athlete while allowing normal cooling of the relatively inactive muscles. The garment includes a sleeve for covering the arm of the athlete and a skirt coupled to the sleeve for covering the deltoid, pectoral and tarus major and tarus minor muscles of the associated arm. Detachable couplers are provided for securing the skirt and the sleeve to the uniform of the athlete.

BRIEF DESCRIPTION OF THE DRAWINGS

Other objects, features and advantages of the present invention will be apparent from a study of the written description and the drawings in which.

Figure 1:
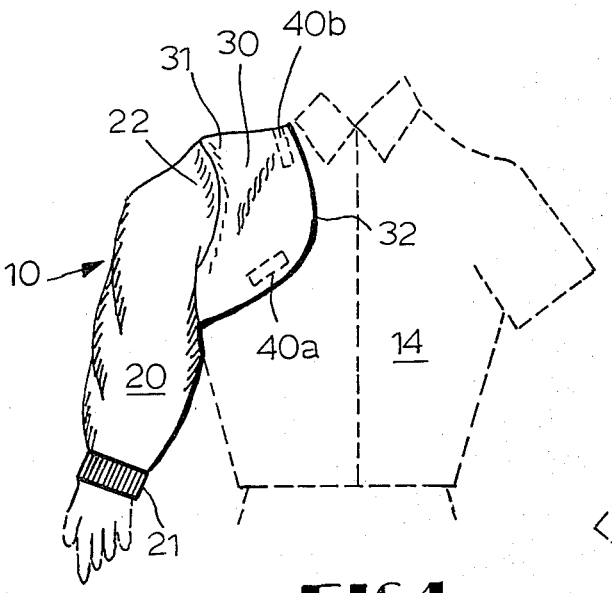
FIG. 1 is a front view of a first preferred embodiment of the differential thermal athletic garment as it is coupled to the right arm of a baseball player.
Figure 5:
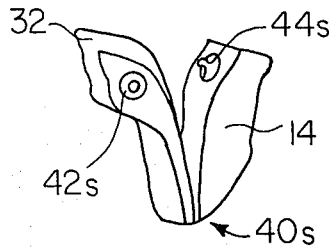
FIG. 5 is a side view of a snap type fastener used with or in place of the Velcro fastener.

In the drawings, like reference characters refer to like parts throughout the single views of the present invention. However, variations and modifications may be effected without departing from the spirit and scope of the concept of the disclosure as defined in the appended claims. It should also be observed that the elements and operation of the embodiment of the present invention have been illustrated in somewhat simplified form in each of the drawings and in the following specification in order to eliminate unnecessary and complicating details which would be apparent to one skilled in this art. Therefore, other specific forms and constructions of the invention will be equivalent to the embodiments described although departing somewhat from the exact appearance of the drawings.

DESCRIPTION OF THE PREFERRED EMBODIMENT

Figure 2:
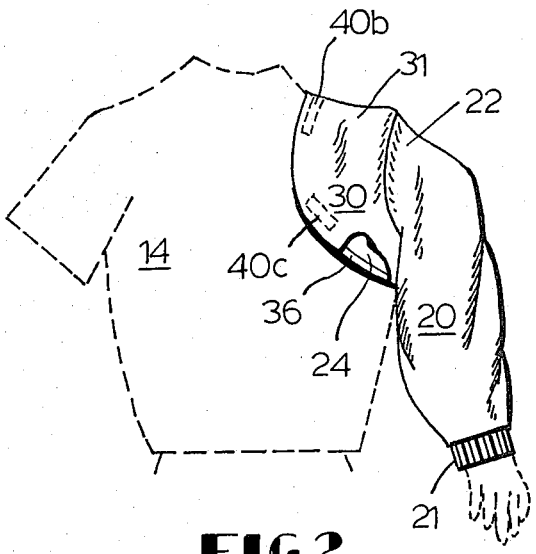
FIG. 2 is a rear view of the same athletic garment fitted over the right arm of the baseball player.
Figure 3:
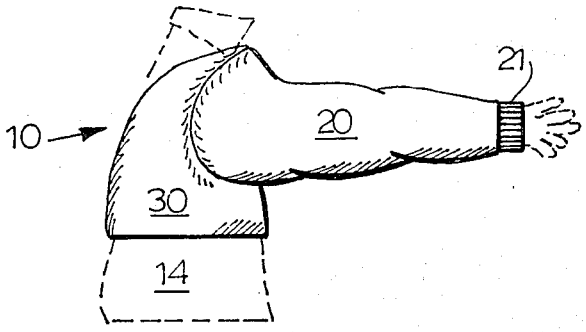
FIG. 3 illustrates a right side view of the athletic garment as worn by the baseball player.

A first preferred embodiment of the thermal garment in accordance with the teachings of the present invention is illustrated generally as 10 in FIGS. 1, 2 and 3. The garment 10 is illustrated as being worn by an athlete over an athletic uniform 14. For purposes of the present discussion it will be assumed that the athlete is engaged in the sport of baseball and that the uniform 14 is a baseball uniform. However, the present invention may be utilized in other sporting events such as javelin throwing, tennis, shot-putting, and various sports which require that the arm muscles be thoroughly warmed up before and in some cases during the competition. Likewise, it may be possible to utilize a derivitave of the first preferred embodiment for warming leg muscles in sporting events such as football place kicking, punting, etc.

With specific reference to FIGS. 1 and 2, the garment 10 comprises a generally tubular sleeve 20 which includes a wrist end 21 and a shoulder end 22. The diameter of the sleeve 20 is constructed along its longitudinal length in order to conform to the muscles of the arm. It is envisioned that an elastic band may be utilized at the wrist end 21 of the sleeve in order to form a loose seal with the wrist of the athlete for preventing the loss of heated air from this end of the sleeve 20.

The sleeve 20 may be constructed of a variety of different materials including cotton, plastic, nylon, or other similar thin and relatively air impervious insulating fabrics. The outside material of the sleeve should be lightweight and relatively flexible in order not to restrict the movements of the athlete's arm. It is also envisioned that the outside fabric of the sleeve 20 will be coated with a moisture-resistant or moisture-repellent coating such as the type presently used in windbreakers or raincoats. This external coating is designed to prevent moisture from penetrating from the outside surface of the sleeve 20, since the evaporation of this moisture would cause absorption of some of the body heat retained by the sleeve 20. The outside moisture-resistant covering of the sleeve 20 will also serve to retain body moisture which creates a warm and penetrating heat within the sleeve. This warm moist heat is more beneficial in maintaining muscle flexability than the dry warmth which would exist if no moisture-resistant covering were provided.

The sleeve 20 may also be fitted with an internal liner 24 manufactured of an insulating-type of material such as cotton, flannel, etc. This insulating liner would provide an additional barrier to the conduction of heat from the outside surface of the sleeve 20 to the arm of the athlete therein. This insulating layer also absorbs some of the perspiration and sweat from the arm of the athlete, and thereby reduces the loss of heat through normal evaporation of these fluids from the skin.

In the first preferred embodiment of the present invention, it is envisioned that the sleeve 20 would be manufactured of a closely woven nylon material impregnated with a plastic or polymer substance for repelling water. The insulative liner within the sleeve 20 would be manufactured of a flannel or similar soft absorptive and insulative material.

With continuing reference to FIGS. 1, 2 and 3, the shoulder end 22 of the sleeve 20 terminates generally at the point where the humerus bone of the upper arm communicates within the glenoid cavity of the scapula bone. A generally semi-circular skirt 30 is coupled about an inner circumference 31 thereof to the shoulder end 22 of the sleeve 20. An outer circumferential edge 32 of the skirt 30 covers the body muscles which are commonly utilized in the sport of baseball. For example, the first preferred embodiment of the present invention is designed to be worn by a baseball pitcher. The baseball pitcher typically is concerned with maintaining body heat in the bicept and tricept muscles of the arm, together with the deltoid muscles of the top and back shoulder area, the pectoral muscles of the front and chest areas and the tarus major and tarus minor muscles of the upper back. The skirt 30 is designed to cover these muscles and therefore to reduce the body heat which escapes when such muscles are not covered or insulated in any manner. It will be apparent that other muscles utilized by athletes in other sporting events may also be covered in accordance with the teachings of the present invention, and therefore the shape of the skirt would vary in accordance with the requirements of each individual sport.

As was previously discussed with regard to the sleeve 20, the external surface of the skirt 30 is manufactured from a relatively thickly woven fabric such as nylon, which either by its inherent characteristics or through the use of a plastic coating, is impervious to air and moisture. An insulative liner also may be used under the external surface of the skirt 30 in order to further reduce the loss of body heat and to absorb body moisture.

A stiffener element 36 is attached along the outer circumferential edge 32 of the skirt 30. This stiffener element 36 may take one of several forms. In the first embodiment the stiffener 36 has the form of a stiff backing material which causes the external circumferential surface of the skirt 30 to maintain a relatively flat shape so as to closely conform with the contour of the chest, shoulder and back muscles of the body. This type of stiffener 36 is well known in the manufacture of clothing, jackets and other wearing apparel as non-woven interfacing (tradename PELLON). It may be sewn or fused to the underneath side of the skirt 30, or in the alternative it may be sewn or fused between the insulative layer 38 and the external layer of the skirt 30.

In a second preferred embodiment of the invention, the stiffener 36 may comprise a relatively stiff but yet deformable plastic material which is molded or fabricated to conform to the shape of the torso in the area of the front chest muscles, the upper shoulder muscles and the rear back muscles.

In a first preferred embodiment of the present invention, several fasteners 40 are provided along the circumferential edge 32 of the skirt 30 for attaching the garment 10 to the uniform 14. These fasteners are typically manufactured under the trademark VELCRO and comprise a plurality of hooks 42 which detachably engage with the plurality of loops 44. The hooks 42 and the loops 44 are typically attached to sheets of flexible fabric **42*a* and 44*b* which may then be sewn to the garment 10 and the athletic uniform 14 respectively. In the present application it is desirable that the hook material 42 be fastened to the underneath side of the skirt 30. In this manner the hooks, if manufactured with the proper length and openings, would be suitable for removably attaching to the loops of relatively loosely woven double knit athletic uniforms. Thus, the hook material 42 would be suitable for use with an athletic uniform 14** which did not incorporate the large loop sections, and therefore could be used with any uniform without any prior modification. Under these circumstances the garment 10 could be utilized by any baseball athlete as long as the loops inherent in the woven material of the fabric comprising the uniform 14 could be latched by the hooks 42.

The first preferred embodiment of the present invention envisions the use of the mating loop fabric 44 which may be sewn to the outside surface of the athletic uniform 14 in an area adjacent to the shoulder and juxtaposed with the hook sections 42 of the Velcro fasteners 40. It is envisioned that approximately three of the fasteners 40 would be required, with one fastener 40*a* being located in the chest area near the lower extremity of the skirt, with a second fastener 40*b* being located on the top of the shoulder at the back surface of the skirt 30 adjacent the shoulder blade but within easy reach of the athlete. It is preferable that discreet segments or patches of the fasteners 40 be utilized rather than long strips of the Velcro fasteners which would be difficult to couple evenly along their entire length.

Figure 4:
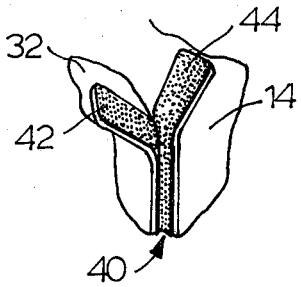
FIG. 4 is a side elevation of a Velcro fastener of the type envisioned for coupling the skirt to the uniform of the baseball player.

It is also envisioned that the standard snap-type fasteners could be substituted for the Velcro fasteners 40 illustrated in FIG. 4 in the case of specific sporting activities. The use of these snap-type fasteners would be suitable if the entire uniform and garment were manufactured as a pair or unit at the onset.

While the preferred embodiment of the invention illustrated herein is specifically designed for use by a baseball pitcher, it is also envisioned that slight modifications may be made to the overall design in order to allow the garment 10 to be utilized by other athletes for protecting and warming the legs.

The use of the garment 10 will be apparent from the preceding descriptions. First, the baseball pitcher or other athlete proceeds with the normal warm-up exercises and activities until all of the body muscles or the main body muscles required in the sport are flexible and warm. The athlete then inserts his arm into the sleeve 20 and secures the fasteners 40 to couple the skirt 30 to the uniform 14. In this manner the body heat from the covered muscles will be retained in order to allow the athlete to maintain his readiness to re-enter the sport. At the same time the other muscles of the body are allowed to cool through the uniform 14. It is desirable under normal circumstances to allow the torso and other relatively less active muscles of the body to cool in order to maintain a safe body temperature. The use of the garment 10 in accordance with the present invention maintains body heat where it is required (that is, in the muscles which will be heavily exercised) while allowing normal body cooling throughout the body muscles which are used more infrequently and which do not require extensive periods of warm-up exercises. The garment 10 may be removed for strenuous exercising by merely pulling apart the elements of the Velcro fastener 40 and removing the sleeve from the arm of the athlete.

Thus, the present invention maintains body exercising heat in the arm and adjacent torso muscles while allowing normal cooling from the remainder of the body.

In accordance with the provisions of the U.S. Patent Laws, a particular preferred embodiment of the present invention has been described in the best mode in which it is now contemplated that such principals may be applied. However, it will be understood that the constructions shown and described in the attached specification and drawings are merely illustrative and that the invention is not limited thereto. Accordingly, alterations and modifications which readily suggest themselves to persons skilled in the art, without departing from the true spirit of the disclosure herein, are intended to be included in the scope of the following claims.

We claim:

1. A thermal garment formed of flexible insulating material for materially retarding the flow of heat from the zone surrounding the muscles and tissues of a selected manipulatable human body appendage and the adjoining major appendage-connecting muscles of an athlete or other person needing or desiring to maintain warmth in an appendage and its connecting muscles and with need or desire to permit a relatively greater degree of cooling of adjacent portions of the body, comprising:

a sleeve extending along and about the length of said appendage desired to be kept warm, which in the case of an arm is down the length of the arm to the wrist zone, a skirt connecting with said sleeve and extending substantially about and over the major body muscles which connect the main body of the athlete to said appendage, which muscles in the case of an arm appendage are the adjacent deltoid, pectoralis, teres major and teres minor muscle groups, said sleeve terminating adjacent the edges of such muscle groups, and attaching means for removably attaching said skirt in generally close-fitting relationship along its periphery, to the exterior surface of an athletic uniform or other body-covering clothing worn by the athlete or other wearer, whereby body heat loss from said appendage and the adjoining main body-connecting and appendage-manipulating muscles will be thereby materially retarded in the area selectively covered by said garment, while the adjoining remainder of the body not covered by said garment may cool at a differentially greater rate as a function of the insulating quality of said uniform and/or such other garment or other covering as may be over the remaining portion of the body, or the absence of any such covering as the case may be, such as is normally the case with body areas not normally covered by a uniform or other clothing, such as the face and hands.

2. A thermal garment according to claim 1, said attaching means comprising releasably interconnectable hook and burr connectors disposed in interfacing relation on respectively the inner surface of said sleeve and the outer surface of said uniform in a zone adjacent the periphery of said sleeve.

3. A thermal garment according to claim 1, said attaching means comprising a plurality of interconnectable interfitting snap fasteners in interfacing relation on said sleeve and said uniform, one portion of each of which fasteners is disposed in inwardly facing relation on said skirt, and a mating portion of each of which fasteners is disposed in outwardly facing relation on the outer surface of said uniform, and the respective positions of the mating portions of said snap fasteners being in closely juxtaposed position when said thermal garment is placed over the uniform or other clothing on the body, so as to enable ease of securement with a generally close-fitting and enclosing relationship of the skirt about and generally restricted to said connecting muscles.

4. A thermal garment according to claim 1, said sleeve having a reduced size terminal cuff area adjacent the wrist zone thereof for closer encompassing relationship with the wrist zone of the wearer.

* * * * *